United States Patent [19]

Schwenzer et al.

[11] Patent Number: 4,658,231

[45] Date of Patent: Apr. 14, 1987

[54] ACTUATING MAGNET WITH ENLARGED PLUNGER POLE PIECE

[75] Inventors: Reinhard Schwenzer, St. Georgen-Langenschiltach; Victor Cohanciuc, Villingen, both of Fed. Rep. of Germany

[73] Assignee: GAS Gesellschaft fur Antriebs-und Steuerungs-technik mbH & Co. KG, St. Georgen, Fed. Rep. of Germany

[21] Appl. No.: 848,120

[22] Filed: Apr. 4, 1986

[51] Int. Cl.[4] ..... H01F 3/00

[52] U.S. Cl. ..... 335/261; 335/279; 251/129.15

[58] Field of Search ..... 335/230, 234, 255, 261, 335/279, 229; 251/129.01, 129.15

[56] References Cited

U.S. PATENT DOCUMENTS

| | | | |
|---|---|---|---|
| 2,992,304 | 7/1961 | Andrews | 335/261 |
| 3,007,493 | 11/1961 | Viale et al. | 137/623 |
| 3,281,741 | 10/1966 | Beliveau | 335/261 X |
| 4,272,747 | 6/1981 | Bauer | 335/261 X |

FOREIGN PATENT DOCUMENTS

| | | |
|---|---|---|
| 1464526 | 11/1963 | Fed. Rep. of Germany . |
| 1464907 | 11/1964 | Fed. Rep. of Germany . |
| 2023126 | 5/1970 | Fed. Rep. of Germany . |
| 2057641 | 11/1970 | Fed. Rep. of Germany . |
| 2158248 | 11/1971 | Fed. Rep. of Germany . |
| 2758072 | 12/1977 | Fed. Rep. of Germany . |
| 3132896 | 8/1981 | Fed. Rep. of Germany . |
| 3312054 | 4/1983 | Fed. Rep. of Germany . |
| 1443957 | 7/1973 | United Kingdom . |

*Primary Examiner*—George Harris

*Attorney, Agent, or Firm*—Poms, Smith, Lande & Rose

[57] ABSTRACT

An Actuating magnet comprises a magnet body (10), an exciting winding (15) arranged in the said magnet body (10) and a radially movable armature (17) having a pre-determined first radial cross-sectional surface. One end of the armature (17) having a second radial cross-sectional surface (19) substantially larger than the said first cross-sectional surface (20) forms a pole piece (18). Between the said pole piece (18) and a wall (11) of the said magnet body (10) which covers in the radial direction at least part of one end face of the said exciting winding (15) there is provided an air gap (20).

In order to increase the actuating force of the magnet without changing its outer dimensions and to provide a closed system, the wall (11) covers the said end face of the exciting winding (15) and shields it magnetically, the pole piece (18) is arranged opposite to the inside of the said wall (11) and the air gap (20) extends in the radial direction (FIGS. 1*a*+*b*).

9 Claims, 5 Drawing Figures

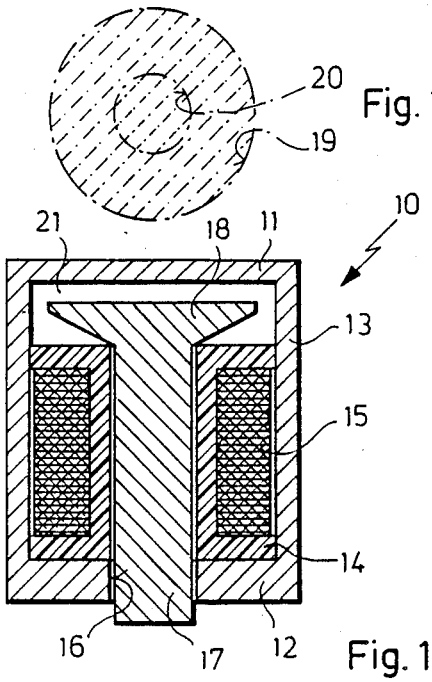
Fig. 1b
Fig. 1a
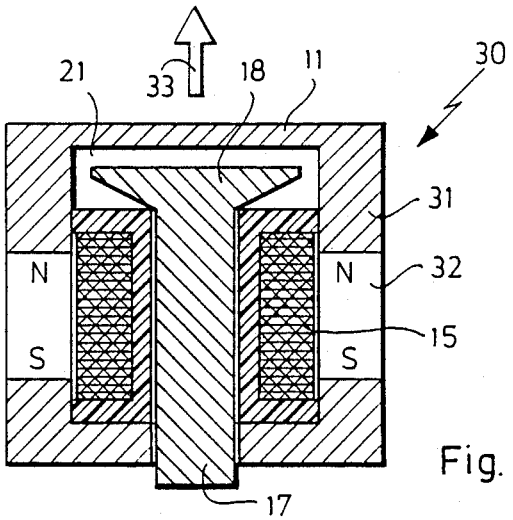
Fig. 2

ACTUATING MAGNET WITH ENLARGED PLUNGER POLE PIECE

The present invention relates to an actuating magnet comprising a magnet body and an exciting winding arranged in the said magnet body and enclosing a radially movable armature having a pre-determined first radial cross-sectional surface, at least one end of the armature forming a pole piece exhibiting a second radial cross-sectional surface substantially larger than the said first cross-sectional surface, and an air gap being provided between the said pole piece and a wall of the said magnet body which covers in the radial direction at least part of one end face of the said exciting winding.

An actuating magnet of this type has been known before from German Disclosure Document No. 20 23 126.

Actuating magnets are generally known and are employed in practice as single lifting magnets, reversing lifting magnets, double lifting magnets, control magnets, pulse magnets and the like, for a plurality of control, regulating and switching functions.

In the case of the known actuating magnets, the armature generally has the shape of a cylindrical body with one end thereof acting as a pole piece and cooperating via the air gap with the wall of the magnet body which closes the magnetic circuit.

This cross-sectional shape of the armature limits the actuating force of the magnet so that correspondingly large actuating magnets have to be used where high actuating forces are required, or else low actuating forces have to be put up with where limitations are imposed regarding the outer dimensions of the magnet.

The before-mentioned German Disclosure Document No. 20 23 126 describes an actuating magnet for a valve in which the armature has the shape of a cylinder with one end tapering outwardly in the form of a cone. The magnet body is designed as a pot core which means that it is of cylindrical shape and comprises a hollow cylindrical cavity receiving the exciting winding. The cylindrical yoke portion arranged in the axis of the magnet body extends over approximately one third of the axial length, and the opposite end face of the magnet body is provided with a conical bore opening to the outside. Thus, the armature can be introduced into the magnet body from the side so that in the attracted condition of the armature, the cylindrical end face of the latter rests against the end face of the axial yoke portion of the magnet body while the opposite, conically enlarged end face of the armature is in contact with the conical bore in the end face of the magnet body.

This means that in the lifted condition of the armature the magnet exhibits two air gaps, namely a radially extending air gap at the cylinder end face of the armature, and a conical air gap in the area of the conical seat of the other end face of the armature and the corresponding surface of the magnet body. Further, in the case of known actuating magnet, the magnetic circuit is opened to the outside when the armature is lifted, because in this condition the field lines are permitted to escape to the outside through the air gap on the end face of the magnetic body.

Thus, it is a disadvantage of the known actuating magnet that due to the two air gaps existing in the inoperative position the lifting magnet, air gap induction is considerably reduced so that comparatively low actuating forces are generated only. In addition, the system is open to the outside.

Now, it is the object of the present invention to improve an actuating magnet of the type described above so that high actuating forces are achieved even with very small dimensions and that the system is protected to the greatest possible degree against external influences.

This object is achieved according to the invention by an arrangement in which the said wall covers the said end face of the exciting winding and shields it magnetically, that the said pole piece is arranged opposite to the inside of the said wall and that the air gap extends in the radial direction.

Thus, the object underlying the invention is solved fully because the outer dimensions of the magnetic body need not be increased, in spite of the enlarged ends of the armature, the exciting winding with its coil shell surrounding the armature requiring anyway a certain minimum diameter which determines also the outer diameter of the magnetic body. The system offers also a high actuating force, there being only one air gap, and is further separated from the outside, the pole piece being arranged opposite the inside of the covering wall.

In a preferred embodiment of the invention, the said second cross-sectional surface is at least twice, preferably eight times, as large as the said first cross-sectional surface This feature provides the advantage that a corresponding increase of the actuating force can be achieved, the latter rising approximately in proportion to the cross-sectional surface.

According to another preferred embodiment of the invention, a permanent magnet is arranged in the magnetic path of the walls, the armature, the pole piece and the air gap.

This measure provides the advantage to permit a pulse magnet or a magnetic clamp to be realized in which case the armature sticks to the wall of the magnet body in the inoperative position, due to the effect of the permanent magnet, and can be released from this position—if necessary with the additional aid of the action of a spring—by a short current pulse from the exciting winding. Due to the enlarged cross-sectional surface of the armature, a current pulse of relatively low amplitude will be required only to overcome a relatively high holding force of the permanent magnet.

According to another embodiment of the invention, the mechanically and/or magnetically biased armature is provided with pole pieces on both ends.

This feature offers the advantage that a bipolar proportional magnet can be realized whose excursion in two opposite directions can be adjusted by increasing or reducing the exciting current. Here again, relatively small currents are required only for running sensitively through a large proportional excursion range.

A particularly advantageous effect is achieved according to the invention when the said pole piece carries a closing body coacting with a valve seat in the neighboring wall of the magnet body.

Alternatively or additionally, one end of the armature may carry a closing body coacting with a valve seat of the neighboring wall of the magnet body.

This feature permits the actuating magnet to act directly as a valve member so that relatively low currents will suffice to realize valves of high operating forces so that, for example, a valve requiring only a low exciting current may be in a position to operate against the high pressure of a fluid to be metered or switched. Accordingly, the use of this embodiment is particularly preferred for switching and control functions in the pneumatic and hydraulic fields.

In one embodiment of the variants mentioned last a chamber is provided in the said magnet body, adjacent the said neighboring wall, and arranged to communicate with the outside of the magnet body through an opening in the said valve seat and also through another opening.

These measures provide the advantage that by integrating the chamber in the magnet body, an operative valve with different switching or control properties can be realized without notably increasing the outer dimensions of the magnet body.

In all the before-described embodiments of the invention, the armature may, preferably, be biased by means of a spring.

This measure offers on the one hand the advantage to ensure defined original positions of the actuating magnet. On the other hand, the spring may, however, either instead of or in addition to the permanent magnet in the magnetic circuit, also serve to implement actuating magnets or combined actuating magnets/valves with proportional characteristics in which case the force of the spring is overcome progressively by the action of a rising exciting current so that the excursion of the armature can be adjusted continuously.

Other advantages of the invention will become apparent from the specification and the attached drawing The invention will be described hereafter in detail with reference to certain embodiments and the drawings in which:

FIGS. 1*a* and 1*b* show a first embodiment of an actuating magnet according to the invention;

FIG. 2 shows another embodiment of the invention acting as a pulse magnet;

Figure 3:
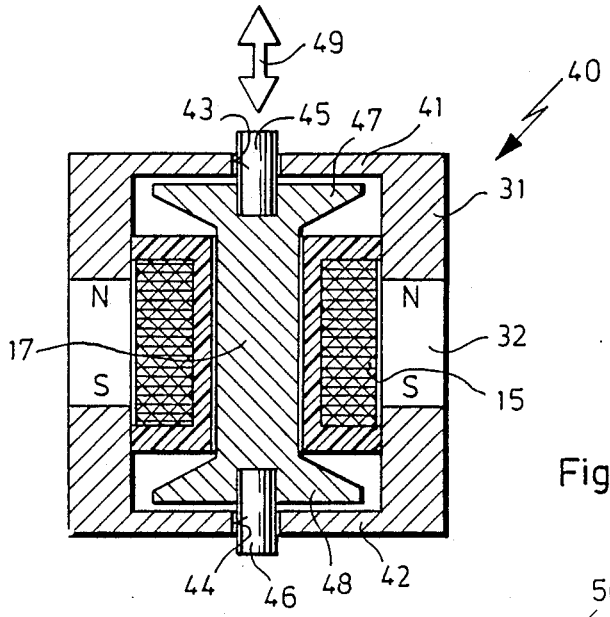
FIG. 3 shows a third embodiment of the invention acting as a bipolar proportional magnet.

In FIG. 1, a magnet body 10 of, for example, axially symmetrical shape can be seen, with FIG. 1*a* showing a radial cross-section through the magnet body 10.

Reference numeral 11 designates a front wall, reference numeral 12 a rear wall and 13 a side wall or cylindrical side wall of the magnet body 10. The coil shell 14 encloses in its inside an exciting winding 15 and on its outside a, for example, cylindrical armature 17 passing through an opening 16 in the rear wall 12. Guides and bearings for the movement of the armature 17 in the coil shell 14 are to be provided as required, but now shown in detail in FIG. 1*a*, being known as such.

The end of the armature 17 facing away from the opening 16 ends in a pole piece 18 exhibiting a considerably enlarged radial cross-sectional surface. In the case of a cylindrical armature 17, this can be achieved by providing a flat conical intermediate section.

In FIG. 1*b*, the radial cross-sectional surface of the pole piece 18 is designated, for example, by 19, and the radial cross-sectional surface of the armature 17 by 20. It can be seen that the surface 19 is several times, for example eight times, larger than the surface 20.

In the unexcited position of the actuating magnet shown in FIG. 1*a*, there is an air gap 21 between the pole piece 18 and the neighboring front wall 11 of the magnet body 10. The armature 17 may stay in this position under the biasing action of a spring not shown in FIG. 1*a*.

Now, when a current is applied to the exciting winding 15, the magnetic circuit will be closed via the walls 11, 13, 12, the armature 17, the pole piece 18 and the air gap 21.

Given the very large radial cross-sectional surface 19 of the pole piece 18, a considerable actuating force is applied on the armature 17 and available for being transmitted to an element to be actuated, via transmission means not shown in FIG. 1, for example piston rods or the like.

The actuating magnet illustrated in FIG. 1 finds a typical field of application, for example, in fluid technology (hydraulics, pneumatics) where magnets of this type can be used with advantage for example for actuating or controlling valves, such as seat valves, sliding valves, flap valves, or the like. The same applications are open to the further embodiments which will be described further below.

It is of course evident that the mechanism for increasing the actuating force through the enlargement of the radial cross-sectional surface 19 of the pole piece 18, as described above with reference to FIG. 1, will remain in effect only as long as no saturation occurs in the ferromagnetic sections of the magnetic circuit. It is, therefore, provided according to the invention that the current applied to the exciting winding 15 is such that the walls 11, 13, 12, the armature 17 and the pole piece 18 are controlled to remain below the magnetic saturation level. This means, in the context of the present invention, that a certain initial saturation (which, as is generally known, does not occur all at once when the exciting current rises) may still be permitted but only to an extent where the effect of the enlarged radial cross-sectional surface 19 of the pole piece 18 is still clearly predominant, as compared to a nonenlarged cross-sectional surface 20.

FIG. 2 shows a further embodiment of the invention comprising a magnet body 30 and a conveniently enlarged side wall 31 with a permanent magnet 32, for example of toroidal shape, inserted therein. The said permanent magnet 32 has the effect to bias the magnetic circuit of the actuating magnet according to FIG. 2, and the pole piece 18 will stick in the inoperative position—possibly against the action of a relatively weak spring—to the neighboring front wall 11, i.e. will have been moved in the direction of arrow 33 to the position opposite the one shown in FIG. 2. Now, when a current pulse is applied to the exciting winding 15 which produces in the magnetic circuit a field pulse directed oppositely to the field of the permanent magnet 32, there is a short moment where the effective field in the air gap 21 is equal to zero so that the armature 17 is released instantaneously in the direction opposite to arrow 33, under the action of the spring not shown in FIG. 2.

FIG. 3 shows still another embodiment of the invention illustrating an actuating magnet in the form of a bipolar proportional magnet. While the configurations of the embodiments illustrated in FIGS. 1 and 2 were suited preferably for switching functions, the embodiment illustrated in FIG. 3 is suited particularly well for proportional control and regulating functions where a continuously varying exciting current is to be transformed into a proportionally varying excursion of the armature 17.

To this end, a magnet body 40 is provided which corresponds largely to the magnet body 30 shown in FIG. 2 and which also comprises an inserted toroidal permanent magnet 32, except that both the front wall 41 and the rear wall 42 are provided with an opening 43 and 44, respectively, receiving piston rods 45 and 46, respectively. The piston rods 45, 46 are fixed to pole pieces 47, 48 formed on both ends of the armature 17.

Now, when an exciting current of continuously varying amplitude is applied to the exciting winding 15, the premagnetization produced by the permanent magnet 32 in the magnetic circuit will be overcome or increased to a greater or lesser degree and the armature 17 will, consequently, move continuously in one of the senses indicated by the double arrow 49.

Figure 4:
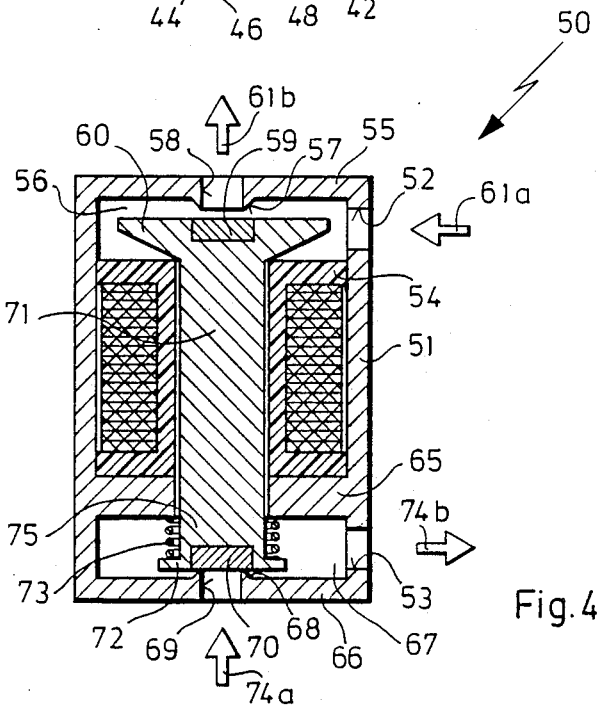
FIG. 4 shows a fourth embodiment of the invention with integrated valve function.

Finally, FIG. 4 shows an actuating magnet with integrated valve function.

A side wall 51 of the magnet body 50 comprises an inlet opening 52 and an outlet opening 53. A radial end wall of a coil shell 54 forms together with a front wall 55 and the side wall 51 a first chamber 56, with a valve seat 57 being arranged around an opening 58 in the front wall 55. The valve seat 57 cooperates with a closing body 59 arranged in a pole piece 60 of the armature 71 adjacent the front wall 55.

In the position shown in FIG. 4, the closing body 59 is lifted off the valve seat 57 so that a pressure fluid may enter the first chamber 56 in the direction of arrow 61*a* through the inlet opening 52 and leave the said chamber through the opening 58 in the direction indicated by arrow 61*b*.

The opposite radial end wall of the coil shell 54 rests against an intermediate bottom 65 of the magnet body 50. In the embodiment shown in FIG. 4, the intermediate bottom 65 is formed integrally with the magnet body 50 and consists, therefore, also of a ferromagnetic material. Accordingly, the magnetic circuit is closed to the armature 71 already via the said intermediate bottom 65 so that the end of the armature 71 facing away from the pole piece 60 does not form part of the magnetic circuit. However, the intermediate bottom 65 may of course also consist of a non-ferromagnetic material, in which case the magnetic circuit would close over the full length of the armature 71, as in the case of the embodiments described before.

A rear wall 66 of the magnet body 50 forms together with the intermediate bottom 65 and the side wall 51 a second chamber 67, the rear wall 66 comprising again a valve seat 68 arranged around an opening 69. The valve seat 68 coacts again with a closing body 70 mounted in the end 65 of the armature 71 facing away from the pole piece 60.

The end 75 is provided with an annular shoulder 72, and a spiral spring 73 is provided between the annular shoulder 72 and the intermediate bottom 65.

In the non-excited position shown in FIG. 4, the closing body 70 is pressed by the spiral spring 73 upon the valve seat 68 so that no pressure fluid can flow through the opening 69.

However, when the actuating magnet shown in FIG. 4 is excited, the pole piece 60 moves towards the front wall 55, against the action of the spiral spring 73, and the closing body 70 is lifted off the valve seat 68. Now, the pressure fluid can enter through the opening 69, in the direction indicated by arrow 74*a*, into the second chamber 67 and leave the latter in the direction indicated by arrow 74*b* through the outlet opening 53.

It appears easily from FIG. 4 that by varying the exciting current continuously it is also possible to adjust any desired intermediate position so that the ratio between the flow rate in the direction of arrows 61*a*/61*b* and the flow rate in the direction of arrows 74*a*/74*b* can be adjusted continuously.

What is claimed is:

1. Actuating magnet comprising a magnet body and an exciting winding arranged in the said magnet body and enclosing a radially movable armature having a predetermined first radial cross-sectional surface, at least one end of the said armature forming a pole piece exhibiting a second radial cross-sectional surface substantially larger than the said first cross-sectional surface, and an air gap being provided between the said pole piece and a wall of the said magnet body which covers in the radial direction at least part of one end face of the said exciting winding, wherein the said wall covers the said end face of the exciting winding and shields it magnetically, the said pole piece is arranged opposite to the inside of the said wall and the air gap extends in the radial direction.

2. Actuating magnet according to claim 1, wherein the said second cross-sectional surface is at least twice, preferably eight times, as large as the said first cross-sectional surface.

3. Actuating magnet according to claim 1, wherein a permanent magnet is arranged in the magnetic path of the said walls, the said armature, the said pole piece and the said air gap.

4. Actuating magnet according to claim 1, wherein the said armature is biased mechanically and/or magnetically and provided with pole pieces on both ends.

5. Actuating magnet according to claim 1, wherein the said pole piece carries a closing body coacting with a valve seat in the neighboring wall of the said magnet body.

6. Actuating magnet according to claim 1, wherein one end of the said armature carries a closing body coacting with a valve seat in the neighboring wall of the said magnet body.

7. Actuating magnet according to claim 5, wherein a chamber is provided in the said magnet body, adjacent the said neighboring wall, and arranged to communicate with the outside of the said magnet body through an opening in the said valve seat and also through another opening.

8. Actuating magnet according to claim 7, wherein the said chamber is delimited at its end facing away from the said neighboring wall by an intermediate bottom of a ferromagnetic material formed integrally with the said magnet body and providing a passage for the said armature.

9. Actuating magnet according to claim 1, wherein the said armature is biased by means of a spring.

* * * * *